US012686978B2

(12) United States Patent
Pawlik et al.

(10) Patent No.: US 12,686,978 B2
(45) Date of Patent: Jul. 21, 2026

(54) LEVELING CONTROLLER ADAPTION BY GROUND PROFILE ANALYSIS

(71) Applicant: JOSEPH VOEGELE AG, Ludwigshafen/Rhein (DE)

(72) Inventors: Christian Pawlik, Neustadt (DE); Martin Buschmann, Neustadt (DE); Ralf Weiser, Ladenburg (DE); Philipp Stumpf, Heidelberg (DE); Stefan Simon, Neuhofen (DE); Tobias Noll, Gossersweiler-Stein (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 791 days.

(21) Appl. No.: 17/990,336

(22) Filed: Nov. 18, 2022

(65) Prior Publication Data

US 2023/0193571 A1 Jun. 22, 2023

(30) Foreign Application Priority Data

Nov. 18, 2021 (EP) ..... 21209122

(51) Int. Cl.
*E01C 23/07* (2006.01)
*E01C 19/00* (2006.01)
*E01C 19/48* (2006.01)

(52) U.S. Cl.
CPC ..... *E01C 23/07* (2013.01); *E01C 19/006* (2013.01); *E01C 19/48* (2013.01)

(58) Field of Classification Search
CPC ..... E01C 19/006; E01C 19/48; E01C 23/07
(Continued)

(56) References Cited

U.S. PATENT DOCUMENTS 5,285,961 A * 2/1994 Rodriguez, Jr. ... G05B 19/0426 236/47
7,845,878 B1 * 12/2010 Godbersen ..... E01C 23/07 404/93

(Continued)

FOREIGN PATENT DOCUMENTS

CN 107632308 A 1/2018
CN 219992116 U 11/2023

(Continued)

OTHER PUBLICATIONS

Chinese Office Action and Search Report, CN Application No. 202211451165.1, Applicant: Joseph Voegele AG, dated Jun. 28, 2025 (with English machine translation) (13 pages).

(Continued)

*Primary Examiner* — Raymond W Addie
(74) *Attorney, Agent, or Firm* — BROOKS KUSHMAN P.C.

(57) ABSTRACT

A method for adapting a leveling control of a road finishing machine comprises:

detecting first ground profile data of a first ground profile of a foundation in a surrounding area of the road finishing machine at point in time t0, wherein the road finishing machine is located at position x0;

detecting second ground profile data of a second ground profile of the foundation in a surrounding area of the road finishing machine at point in time t1, wherein the road finishing machine is located at position x1, and the second ground profile partially overlaps the first ground profile;

determining a translational and rotational matrix which maps a movement of the road finishing machine in space from the point in time t0 to the point in time t1;

creating corrected ground profile data from the ground profile data by means of the matrix;

(Continued)

determining an analysis region LA comprising at least a section of the first ground profile data L0 and/or a section of the corrected ground profile data;

analyzing the analysis region;

adapting the leveling control for a distance of the analysis region by means of data obtained in the analysis.

16 Claims, 3 Drawing Sheets

(58) Field of Classification Search
USPC ..... 404/75, 84.05–84.5, 118
See application file for complete search history.

(56) References Cited

U.S. PATENT DOCUMENTS

| | | | | |
|---|---|---|---|---|
| 8,696,237 | B2 | 4/2014 | Hanfland et al. | |
| 9,290,891 | B1 * | 3/2016 | Caswell | E01C 23/07 |
| 9,290,894 | B2 | 3/2016 | Eul | |
| 9,534,349 | B2 * | 1/2017 | Horn | E01C 19/42 |
| 2010/0129152 | A1 | 5/2010 | Taylor | |
| 2012/0263632 | A1 * | 10/2012 | Campbell | F01N 3/2066 423/212 |
| 2012/0321384 | A1 * | 12/2012 | Hanfland | E01C 19/48 404/72 |
| 2012/0321385 | A1 * | 12/2012 | Hanfland | G01B 21/08 404/84.1 |
| 2013/0051913 | A1 * | 2/2013 | Eul | E01C 19/48 404/83 |
| 2015/0063907 | A1 * | 3/2015 | Graham | E01C 23/07 715/745 |
| 2021/0317620 | A1 | 10/2021 | Buschmann et al. | |

FOREIGN PATENT DOCUMENTS

| | | | |
|---|---|---|---|
| DE | 102004048637 | A1 | 4/2006 |
| DE | 10 2009 044581 | A1 | 6/2010 |
| EP | 2 535 456 | A1 | 12/2012 |
| EP | 2 687 631 | B1 | 8/2015 |
| EP | 3892777 | A1 | 10/2021 |
| JP | 2013047454 | A | 3/2013 |
| JP | 2013170897 | A | 9/2013 |

OTHER PUBLICATIONS

European Search Report Dated Apr. 21, 2022, Application No. 21209122.7-1005, Applicant Joseph Voegele AG, 9 Pages.

JPO Office Action in JP Application No. 2022-183572 dated May 29, 2026 (4 pages, including English translation).

* cited by examiner

LEVELING CONTROLLER ADAPTION BY GROUND PROFILE ANALYSIS

CROSS-REFERENCE TO RELATED APPLICATIONS

This application claims foreign priority benefits under 35 U.S.C. § 119(a)-(d) to European patent application number EP 21209122.7, filed Nov. 18, 2021, which is incorporated by reference in its entirety.

TECHNICAL FIELD

The present disclosure relates to a method for adapting a leveling control of a road finishing machine, as well as a road finishing machine.

BACKGROUND

A road finishing machine comprises a towing vehicle and a screed, the screed being connected to the towing vehicle by means of a screed arm. The towing point, that means the place where the screed arm is connected with the towing vehicle, is height adjustable. Via the towing point height, irregularities can be compensated and layer thicknesses adjusted. It is known to perform the adjustment of the towing point height, that means the leveling control, automatically based on detected measured quantities. For example, the height of the surface of the foundation to be asphalted can be detected by means of a mechanical sensor or an ultrasonic sensor to adjust the leveling control based thereon. To this end, height reference systems, such as a guiding wire or a rotational laser, can also be used.

It is known from EP 2 687 631 B1 to create a three-dimensional surface profile of the foundation in the form of a point cloud. To this end, a 3D scanner, in particular a laser scanner, is provided at the road finishing machine. A control system of the road finishing machine converts the point cloud into a control signal for the leveling control.

With all automatic methods for the leveling control, it has been disadvantageous up to now that despite the detection of the height profile of the foundation, and thereby its irregularities, the automatic leveling control still creates irregularities in the laid road pavement during the laying operation.

SUMMARY

It is an object of the present disclosure to provide a method for the adaption of a leveling control and a road finishing machine wherein the paving quality is further improved.

A method according to the disclosure for the adaption of a leveling control of a road finishing machine comprises the following method steps:

- detecting first ground profile data L0 of a first ground profile of a foundation in a surrounding area of the road finishing machine at the point in time t0, wherein the road finishing machine is located at position x0;
- detecting second ground profile data L1 of a second ground profile of the foundation in a surrounding area of the road finishing machine at the point in time t1, wherein the road finishing machine is located at position x1, and wherein the second ground profile partially overlaps the first ground profile;

- determining a translational and rotational matrix M which maps a movement of the road finishing machine in space from the point in time t2 to the point in time t1;
- creating corrected ground profile data L1' from the ground profile data L1 by means of the matrix M;
- determining an analysis region LA comprising at least a section of the ground profile data L0 and/or a section of the corrected ground profile data L1';
- analyzing the analysis region LA, in particular determining changes of height;
- adapting the leveling control for the distance of the analysis region LA by means of the data obtained in the analysis.

The procedure steps are suited to be executed in the sequence represented here.

The creation of corrected ground profile data L1' by means of the translational and rotational matrix M compensates the own movement of the road finishing machine with the ground profile scanner attached thereon. In this manner, from a sequence of detected and corrected ground profile data L0 (=L0), L1', L2', L3', . . . , Ln', a coherent region of digital ground profile data Lges' can be created and stored. The analysis region LA can extend across a desired section of the ground profile data Lges' and have, for example, a length of 2 to 15 meters. Preferably, the analysis region LA has a length of 5 meters or 10 meters. The analysis regions LA can then follow each other and each form the basis of a new calculation of the adaption of the leveling control. This means, the movement of the road finishing machine is corrected to a quasi-floating movement. Adapting the leveling control for the distance of the analysis region LA means an influence or adjustment of the leveling control or the leveling controller, that means their functioning per se, that means, it represents a step preceding the leveling control. The adapted leveling control then performs the laying of the corresponding road section. The formerly known and firmly configured leveling controllers often generated a waviness of the newly laid road pavement when they detect an irregularity of the foundation compared to a height reference, for example a guiding wire. This waviness can now be reduced or even eliminated by adapting the controlling behavior of the leveling control in response to the analyzed changes of height.

The detection of the ground profile data can be accomplished with a ground profile scanner disposed at the road finishing machine. The surrounding area of the road finishing machine in which the ground profile data are detected can in particular be a region in front of the road finishing machine or laterally of the road finishing machine. As an alternative, it is also conceivable that the detection of the ground profile data is accomplished with a ground profile scanner disposed at a preceding feeder. The determination of the translational and rotational matrix M can be accomplished based on the overlap of the first and the second ground profiles. The translational and rotational matrix M can map the complete movement of the road finishing machine, that means the translation and rotation in all three directions in space. The matrix M in particular maps the movement of travel and inclination movements about a longitudinal and/or transverse axis of the road finishing machine. The inclination movements can be caused, for example, by irregularities of the foundation. The analysis of the analysis region LA can in particular comprise the determination of heights of irregularities compared to a reference height. The adaption of the leveling control can comprise an adaption of one or several parameters and/or the selection of input quantities to be used, in particular sensor data. The adaption of the leveling control can moreover comprise the selection of sub-units of the leveling control to be used, that means, for example, individual controller elements, calculation blocks, algorithms or the like.

Preferably, the first and second ground profiles are one- or two-dimensional and have at least one direction in space parallel to the direction of travel of the road finishing machine. Thus, irregularities in particular running transverse to the direction of travel which have a predominant influence on the smoothness of the road pavement can be detected. In particular, a line scan running in parallel to the direction of travel can be performed, for example, by means of a laser scanner. The line scan of the ground profile data L1 can then partially overlap the line scan of the ground profile data L0. A corresponding overlap of the measurements can then be accomplished each for the ground profile data Ln and Ln−1, wherein the road finishing machine has moved between the measurements in the direction of travel each by a certain distance. The detection of the ground profile data, that means the scan, is suitably accomplished at a speed that is high compared to the speed of the road finishing machine, so that the road finishing machine does not have to stop for the measurement. A three-dimensional ground profile detection of an area of the foundation, for example by means of a stereo camera, is also conceivable. The respective successive three-dimensional area recordings can also overlap in sections. Equally, two line scans can be performed by two ground profile scanners arranged one next to the other. The two line scans then in combination have an extension of length, height, and width (two adjacent data points) and thereby represent already a three-dimensional data record.

Preferably, the leveling control comprises at least one of the following controllers: a robust control, an H-infinity control, a model predictive control and/or a PID controller (proportional, integral, differential controller). The controllers can be suited to be optimized with respect to a certain wavelength.

In a preferred variant, the leveling control comprises a PID controller (proportional, integral, differential controller), and the adaption of the leveling control comprises the adjustment of the P parameter and/or the I parameter and/or the D parameter of the PID controller, or the selection of a set of PID parameters. Thus, an optimal damping of the PID controller and thus the leveling control can be achieved. An occurring irregularity in the form of a step or an edge or a series of irregularities, which can be considered as waves having a certain frequency or wavelengths and amplitudes, are now taken into consideration such that no build up or oscillation of the screed by a PID controller of the leveling control takes place, but an optimal damping of the interferences, and thus a plane installation, is accomplished. It can be convenient to select, when a step or a certain wavelength is detected, a set of PID parameters previously defined for this, that means a fixed P, I and D proportion. Corresponding associations of the analysis results with the parameters can be stored in tables or be stored, by means of an analytic correlation, in particular a mathematic association by means of an equation or formula, in a storage of a digital control system.

In one variant, the adaption of the leveling control comprises the selection of one or more leveling sensors which are arranged at different positions in the longitudinal direction of the road finishing machine. Leveling sensors measure a height to the foundation or to a height reference, such as, for example, a guiding wire. Leveling sensors can be ultrasonic sensors or mechanical sensors. A plurality of leveling sensors can be attached laterally at the road finishing machine along a longitudinal axis. The leveling sensors can be attached to a screed arm. Equally, leveling sensors can be attached to the chassis or the material bunker of the road finishing machine. The leveling sensors can be arranged at a support laterally of the road finishing machine, the support being connected with the road finishing machine. The support can have a length of 5 meters to 15 meters, in particular a length of 13 meters. Three to five ultrasonic sensors can be arranged at the support. An ultrasonic sensor arranged at the very front in the direction of travel can be arranged at a distance from a rear ultrasonic sensor of essentially 15 meters, in particular 13 meters. The controlling quality of the leveling control, that means in particular the evenness of the paving, can, depending on the wavelengths of the irregularities in the foundation, further depend on the sensor position. Thus, medium wavelengths can be better smoothed with a sensor position closer to the screed, and large wavelengths can be better smoothed with a position of the leveling sensor nearer to the towing point of the screed. By a corresponding selection of the leveling sensor according to its position and depending on the measured wavelength, the evenness of the laid pavement can be further improved. Two or several leveling sensors can also be selected, and an average value can be formed from their measured values. If an irregularity in the form of a step is detected, as a consequence, a leveling sensor of a certain position can also be selected.

In an advantageous variant, the adaption of the leveling control is accomplished taking into consideration a wavelength spectrum of changes of heights of the foundation and/or detected amplitudes of changes of heights determined during the analysis of the analysis region LA. Thus, prevailing characteristics of recurring irregularities and also singular irregularities, such as steps, can be taken into consideration for the adaption of the leveling control.

In one variant, the adaption of the leveling control is accomplished on the basis of a selective weighting of wavelengths of detected changes of height. Thus, the prevailing wavelength of a wavelength spectrum can be identified, and it can serve, for example, as a basis for the selection of the parameters of the leveling control. Equally, it can serve as a basis for the selection of the leveling sensor. Equally, the amplitudes of the detected changes of height can be weighted. Thus, a filtering of irregularities can be accomplished, such that not all irregularities have the same effect on the leveling behavior. For example, the adaption of the leveling control can be accomplished such that short irregularities only have a minimal influence on a controller, for example by reducing the D proportion in the PID controller. In case of longer irregularities, an amplification of the controller sensitivity is also possible for supporting the own leveling behavior of the road finishing machine.

Preferably, the determination of the translational and rotational matrix M is effected by means of a scan matching algorithm. A scan matching algorithm is a method for finding a spatial transformation to align two sets of data points or two point clouds. The data points of the second ground profile data L1 corresponding to the part of the second ground profile that overlaps the first ground profile can be consulted for the scan matching algorithm and be aligned with the corresponding data points of the first ground profile data L0 to thus determine the translational and rotational matrix M. The scan matching algorithm can successively be performed each for two successively determined ground profile data Ln and Ln−1. In particular, the determination of the translational and rotational matrix M can be effected by means of an iterative algorithm. In particular, the determination of the translational and rotational matrix M can be effected by means of an iterative closest point algorithm (ICP).

Preferably, the determination of the translational and rotational matrix M comprises the processing of position data determined by means of a GNSS module (Global Navigation Satellite System) and/or the processing of travel drive data and/or the processing of stationary georeferencing. These variants of data processing can be particularly suitable if the foundation is very even and does not have any significant irregularities. In particular the horizontal translation of the road finishing machine can be determined thereby. These methods can also be employed as a supplement to the scan matching algorithm. Position data received with GPS (Global Positioning System) can be processed. By means of a detected travel speed of the road finishing machine, its travel and thus position can be determined. Equally, angles of lock can be detected and processed. To this end, sensors can be provided at the drive and/or the steering system of the road finishing machine. A stationary georeferencing system can be laser-based and can detect the position of the road finishing machine with respect to previously installed reference points. Furthermore, an inertial navigation system can be employed.

In one variant, the analysis of the analysis region LA comprises a Fast Fourier Transformation and/or a discontinuity detection, in particular a formation of differences. The Fast Fourier Transformation in particular serves to analyze the frequency spectrum of the irregularities, that means of recurring types of irregularities. Thus, a wavelength spectrum and the individual wavelengths of the irregularities can be detected. The discontinuity detection can in particular also detect steps, holes, milling edges and similar irregularities scatteredly occurring in the analysis region LA.

In a preferred variant, the layer thickness of the already laid pavement is measured, and the adaption of the leveling control is effected taking into consideration the measured layer thickness. Thus, the paving result can be controlled and further improve, as a feedback, the adaption of the leveling control. It is also possible for the layer thickness of the laid pavement to directly act on the leveling control as a feedback.

In one variant, the method is performed for two or several adjacent measuring paths by means of two or several ground profile scanners arranged at the road finishing machine. Thus, on the one hand, the paving quality can be further improved since a larger database is present. For example, the adaption of the leveling control can be accomplished on the basis of an average value of the obtained ground profile data of the two adjacent measuring paths. The ground profile data of the two measuring paths can, however, also serve completely or at least partially separately for the separate adaption of the leveling control of the right and the left towing point of the screed.

A road finishing machine according to the disclosure comprises a screed and a chassis, wherein the screed is hinged to the chassis by means of a screed arm via a towing point. The towing point height is height adjustable by means of a leveling cylinder. The road finishing machine furthermore comprises a leveling sensor and a ground profile scanner. The road finishing machine comprises a control system with a leveling controller or leveling control to control the towing point height taking into consideration the data of the leveling sensor. The control system is configured to parameterize the leveling controller on the basis of the data detected with the ground profile scanner. Suitably, the screed can be hinged to a left and a right side of the chassis by means of a left and a right screed arm via one towing point each. Correspondingly, there is a left and a right leveling cylinder. The control system can comprise a component for data storage, a component for data processing, and an interface for the data input and data output. The leveling sensor can be an ultrasonic sensor, a laser sensor, or a mechanical tactile sensor.

Preferably, the road finishing machine comprises two or several leveling sensors which are arranged along a longitudinal direction of the road finishing machine, wherein the control system is configured to select, on the basis of the data detected with the ground profile scanner, one or several leveling sensors to be used with the leveling controller. Thus, depending on the measured irregularities, that or those leveling sensor or sensors can be selected which achieve(s) the best paving result with these irregularities. One or several leveling sensors can be arranged each at the left and the right side of the road finishing machine. The leveling sensors can be attached to a screed arm. Equally, leveling sensors can be attached to the chassis or the material bunker of the road finishing machine. The leveling sensors can be arranged at a support laterally of the road finishing machine, wherein the support is connected with the road finishing machine. The support can have a length of 5 meters to 15 meters, in particular a length of 13 meters. Three to five ultrasonic sensors may be arranged at the support. An ultrasonic sensor arranged at the very front in the direction of travel can be arranged at a distance from a rear ultrasonic sensor of essentially 15 meters, in particular 13 meters.

In one variant, the ground profile scanner is a laser scanner. In particular, the ground profile scanner can be a line scanner which collects ground profile data of a ground profile along a line. This line scan can extend in parallel to the direction of travel of the road finishing machine. The ground profile scanner can be arranged centrically or laterally at the road finishing machine. The ground profile scanner can be arranged laterally at the road finishing machine such that the line scan is not obstructed by a truck that is loading the material bunker of the road finishing machine, but extends laterally thereof.

In one advantageous variant, the road finishing machine comprises two or several ground profile scanners. Thus, ground profile data of two or several parallel ground profiles can be detected. These can then be combined for a further improved adaption of the leveling control. However, the data can also be used separately for the separate adjustment of the leveling control of a right and a left towing point of the screed.

The road finishing machine according to the disclosure is suited to perform the method according to the disclosure for adapting a leveling control.

BRIEF DESCRIPTION OF THE DRAWINGS

In the following, exemplified embodiments of the disclosure are described more in detail with reference to the figures. In the drawings.

Corresponding components are always provided with the same reference numerals in the figures.

DETAILED DESCRIPTION

Figure 1:
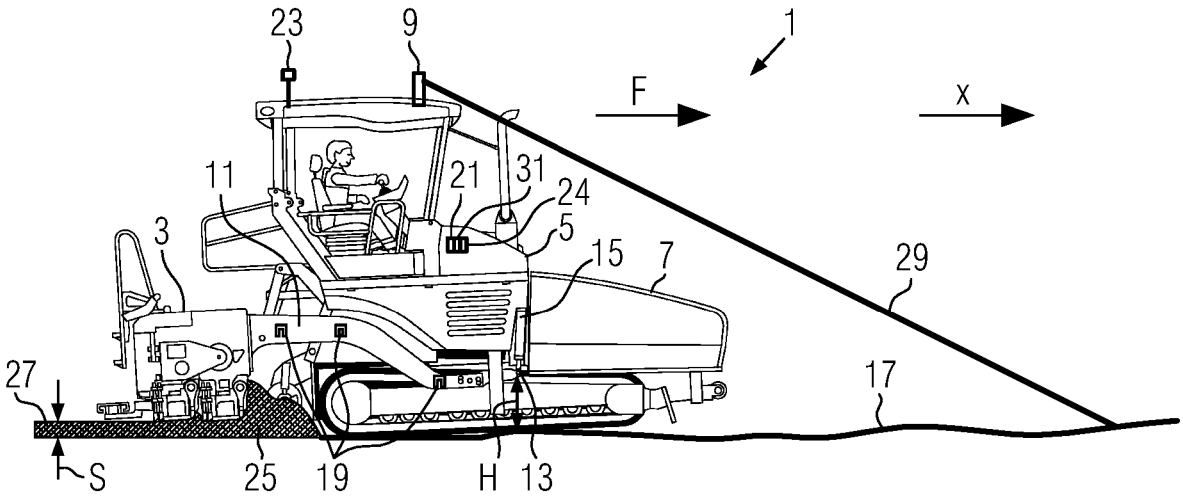
FIG. 1 shows a side view of a road finishing machine with a ground profile scanner.

FIG. 1 shows a road finishing machine 1 with a screed 3, a chassis 5, a material bunker 7, and a ground profile scanner 9. The screed 3 is hinged to the chassis 5 by means of a screed arm 11 via a towing point 13. The towing point 13 is height adjustable by means of a leveling cylinder 15 and has a height H with respect to a height reference, for example a guiding wire or a foundation 17. Three leveling sensors 19 are arranged at the screed arm 11 at different positions in a longitudinal direction F of the road finishing machine 1. The road finishing machine 1 furthermore comprises a control system 21 which is suited for sending, receiving, and processing data, and an antenna 23 for sending and/or receiving data, for example a GNSS signal. To this end, the antenna 23 can be connected with a GNSS module 24 which in turn is connected with the control system 21. The ground profile scanner 9 detects a ground profile of the foundation 17 on which the road finishing machine 1 is moving in the direction of travel x and is laying paving material 25 by means of the screed 3 to form a new pavement 27 with a layer thickness S. The ground profile scanner 9 of the shown embodiment is a laser scanner and scans the surface of the foundation 17 with a laser beam 29. The laser beam 29 is pivotable about an axis transverse to the direction of travel x to detect ground profile data longitudinally to the direction of travel x by means of a line scan. The ground profile data serve as a basis for parameterizing a leveling controller 31 which can be part of the control system 21.

Figure 2:
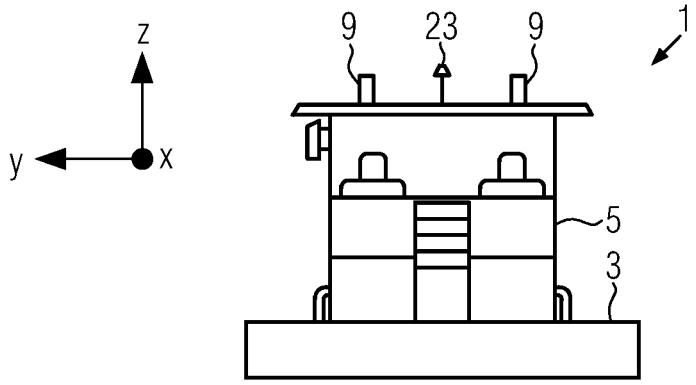
FIG. 2 shows a rear view of a road finishing machine with two ground profile scanners.

FIG. 2 shows a rear view of a road finishing machine 1 with a screed 3, a chassis 5, an antenna 23, and two ground profile scanners 9. With this arrangement of two ground profile scanners 9, two ground profiles that are parallel in the direction of travel x can be detected.

Figure 3:
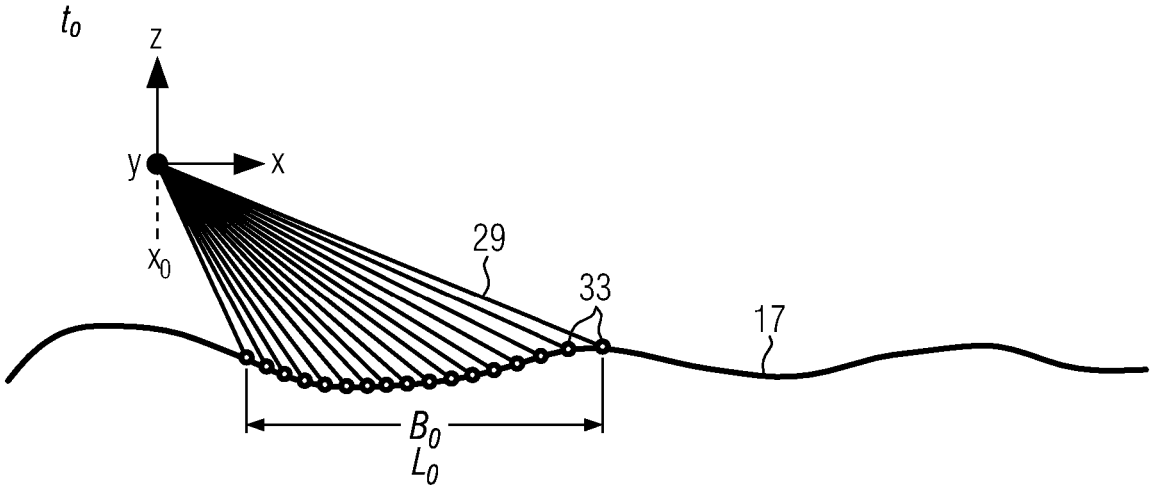
FIG. 3 shows a schematic view of a ground profile detection at the point in time t0.

FIG. 3 shows a schematic view of a ground profile detection at the point in time t0, where the road finishing machine 1 is located at a position x0. A laser beam 29 emitted by the ground profile scanner 9 successively scans a first ground profile B0 of the foundation 17 parallel to the direction of travel x. For this, the laser beam 29 can be pivoted about a y-axis transverse to the direction of travel x which is represented here by several lines for the time history of the position of the laser beam 29. The first ground profile B0 is detected by a line scan, where the ground profile scanner 9 is located at a certain position y. The y-axis extends transversely to the direction of travel x. The generated first data points 33 together form the first ground profile data L0 of the first ground profile B0 which can be stored and processed, in particular by the control system 21.

Figure 4:
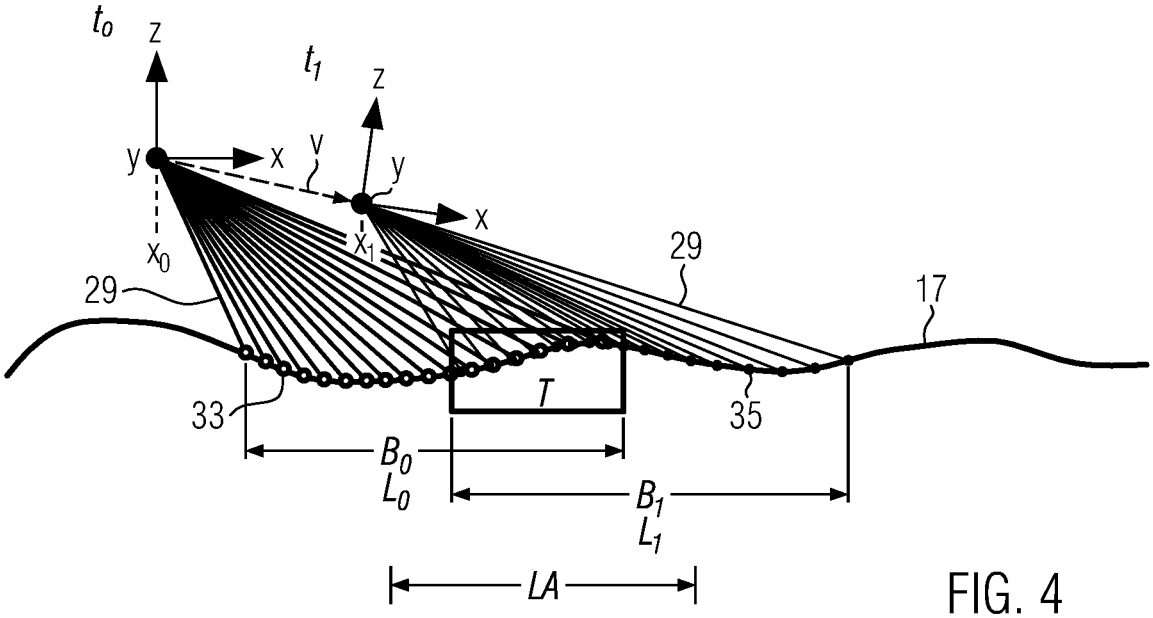
FIG. 4 shows a lateral schematic view of a ground profile detection at the point in time t0 and a ground profile detection at the point in time t1.

FIG. 4 shows a lateral schematic view of a first ground profile detection at the point in time t0 according to FIG. 3 and a second ground profile detection at the point in time t1. As in FIG. 3, the first data points 33 generated at the point in time t0 which together form the first ground profile data L0 are represented as hollow circles. The second data points 35 generated at the point in time t1 which together form the second ground profile data L1 are represented as solid circles. In an overlap region T, the first ground profile data L0 and the second ground profile data L1 overlap. From the point in time t0 to the point in time t1, the road finishing machine 1 has moved according to the vector V and has performed, due to the ground irregularity, a rotation, for example a tilting, as is represented by the shown coordinate systems. The overlap region T is the starting basis for determining the translational and rotational matrix M which maps the movement of the road finishing machine 1 from the point in time t0 to the point in time t1. The determination of the translational and rotational matrix M can be effected by means of a scan matching algorithm, in particular by means of an iterative closest point algorithm (ICP) by means of the first data points 33 and the second data points 35. For adapting the leveling control, a suited analysis region LA is selected whose changes of height are analyzed. The analysis region LA can comprise data points 33, 35 of the first ground profile data L0 and the second ground profile data L1. For example, the analysis region LA can have a length of 5 meters.

Figure 5:
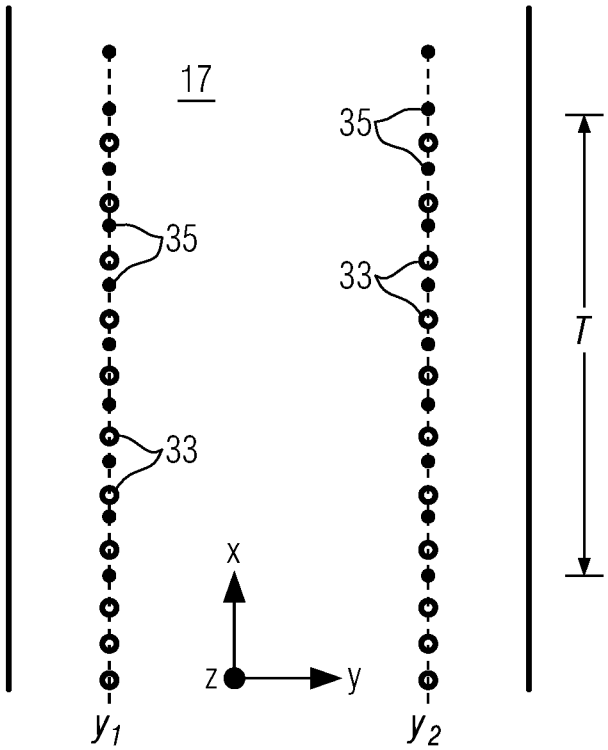
FIG. 5 shows a schematic plan view of a ground profile detection at the point in time t0 and a ground profile detection at the point in time t1.

FIG. 5 shows a schematic plan view of a ground profile detection at the point in time t0, and a ground profile detection at the point in time t1, wherein two parallel line scans are performed at the positions y1 and y2 by means of two ground profiles scanners 9. The overlap region T in which the first data points 33 of the first ground profile data L0 and the second data points 35 of the second ground profile data L1 overlap is shown. The left line scan at position y1 and the right line scan at position y2 can be combined, for example by averaging, for an adaption of a leveling control. The left line scan and the right line scan can, however, also be used separately for adapting one separate leveling control each of a left and a right towing point 13.

Figure 6:
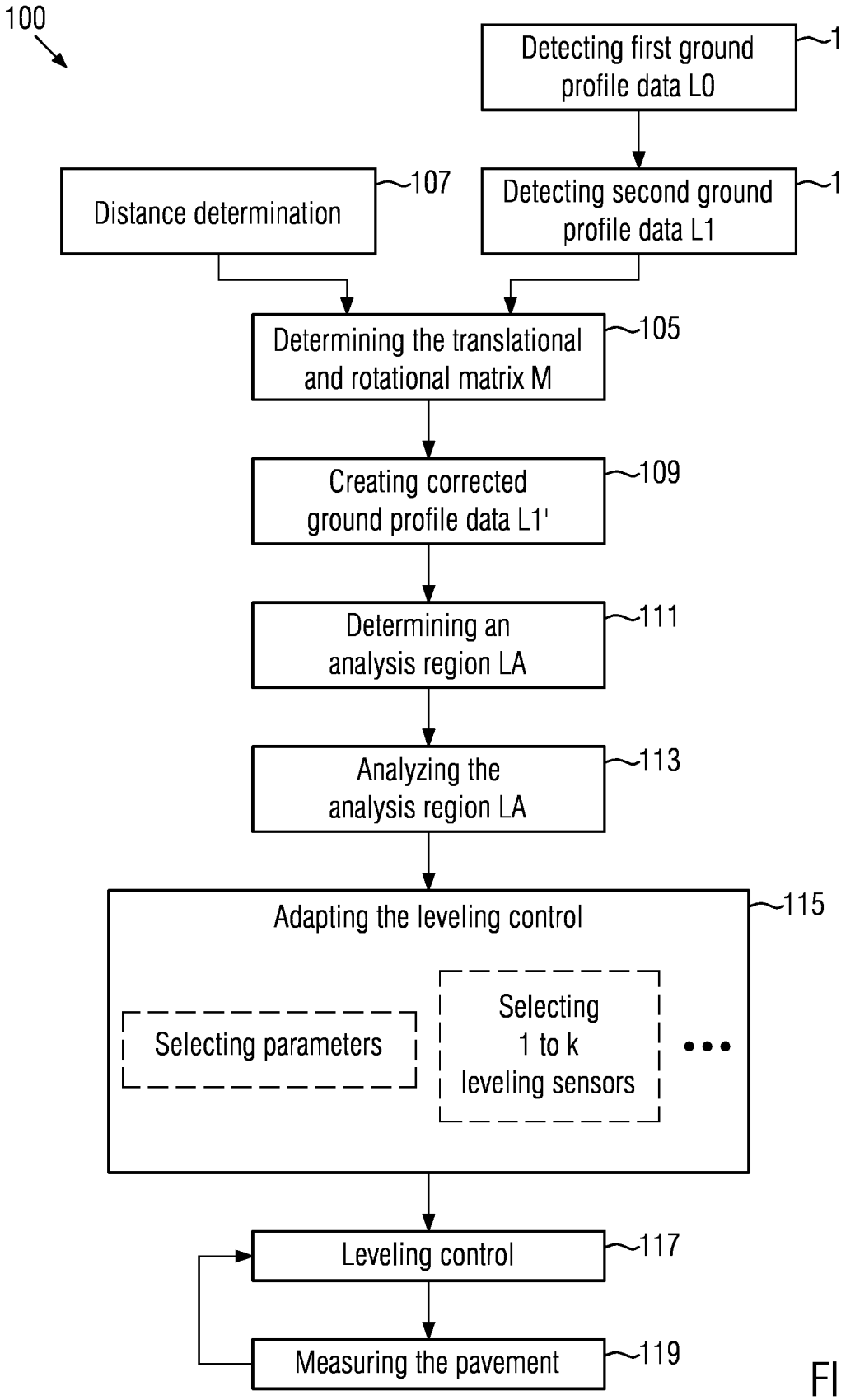
FIG. 6 shows a flowchart of a method for the adaption of the leveling control of a road finishing machine.

FIG. 6 shows a flowchart of a method 100 for the adaption of a leveling control of a road finishing machine 1. The following procedure steps are performed:

101—Detecting first ground profile data L0 of a first ground profile B0 of the foundation 17 in a surrounding area of the road finishing machine 1 at the point in time t0, wherein the road finishing machine 1 is located at position x0.

103—Detecting second ground profile data L1 of a second ground profile B1 of the foundation 17 in a surrounding area of the road finishing machine 1 at the point in time t1, wherein the road finishing machine 1 is located at position x1, and the second ground profile B1 partially overlaps the first ground profile B0.

The detection of the ground profile data B0, B1 can be effected by a line scan with the ground profile scanner 9.

105—Determining the translational and rotational matrix M which maps a movement of the road finishing machine 1 in space from the point in time t0 to the point in time t1. For determining the translational and rotational matrix M, the data of a distance determination 107 which determines, for example by means of a GNSS receiver and/or sensors of the travel drive of the road finishing machine 1, position data of the road finishing machine 1 can be consulted.

109—Creating corrected ground profile data L1' from the ground profile data L1 by means of the matrix M. As a result, continuous ground profile data Lges' are obtained which can extend up to a length corresponding to the sum from the first ground profile B0 and the second ground profile B1. More than two corresponding ground profile data can also be detected, corrected, and combined.

111—Determining an analysis region LA comprising at least a section of the ground profile data L0 and/or a section of the corrected ground profile data L1'. The analysis region LA can also comprise further corrected ground profile data Ln'. The analysis region LA can conveniently be determined anew in the course of the laying operation. For example, the analysis region LA can comprise a length of 5 m each, and thus, adjacent analysis regions LA can be defined which each represent the basis for the further procedure steps.

113—Analyzing the analysis region LA, in particular determining changes of height. The analysis can comprise a Fast Fourier Transformation and/or a discontinuity detection, in particular the formation of differences. As a result of this procedure step, the changes of height of the foundation 17 in the analysis region LA are known. In particular, the analysis can indicate a wavelength spectrum of the changes of height, indicate the frequency and amplitude of a wavelength spectrum and individual changes of height, and indicate singular changes of height, such as for example steps.

115—Adapting the leveling control for the distance of the analysis region LA by means of the data obtained by the analysis. For example, in response to a determined wavelength, the parameters of the employed controller or controllers can be adjusted. For example, the parameters P_n, I_n, D_n of a PID controller can be adjusted. Equally, the parameters of the controller, in particular the PID controller, can be adjusted in response to a single irregularity, for example a step. Furthermore, l to k of the present k leveling sensors 19 can be selected for the subsequent leveling control 117.

117—Leveling control during the paving operation. With the adapted leveling control 31, the laying of the paving material 25 into a road pavement 27 is accomplished. In the process, the leveling control 31 controls the leveling cylinders 15 to adjust the towing point height H.

119—Measuring the pavement. The newly laid road pavement 27 can be measured, for example to determine a layer thickness. These measuring results can then additionally influence the leveling control 117 as a feedback mechanism.

As those skilled in the art will understand, the control system 21, the leveling control 31, as well as any other controller, unit, component, module, system, subsystem, interface, sensor, device, or the like described herein may individually, collectively, or in any combination comprise appropriate circuitry, such as one or more appropriately programmed processors (e.g., one or more microprocessors including central processing units (CPU)) and associated memory, which may include stored operating system software, firmware, and/or application software executable by the processor(s) for controlling operation thereof and for performing the particular algorithm or algorithms represented by the various methods, steps, functions and/or operations described herein, including interaction between and/or cooperation with each other. One or more of such processors, as well as other circuitry and/or hardware, may be included in a single Application-Specific Integrated Circuit (ASIC), or several processors and various circuitry and/or hardware may be distributed among several separate components, whether individually packaged or assembled into a System-on-a-Chip (SoC).

What is claimed is:

1. A method for adapting a leveling control of a road finishing machine, comprising:

detecting first ground profile data L0 of a first ground profile B0 of a foundation in a surrounding area of the road finishing machine at a point in time t0, wherein the road finishing machine is located at position x0;

detecting second ground profile data L1 of a second ground profile B1 of the foundation in a surrounding area of the road finishing machine at a point in time t1, wherein the road finishing machine is located at position x1, and the second ground profile B1 partially overlaps the first ground profile B0;

determining a translational and rotational matrix M which maps a movement of the road finishing machine in space from the point in time t0 to the point in time t1;

creating corrected ground profile data L1' from the second ground profile data L1 by means of the matrix M;

determining an analysis region LA comprising at least a section of the first ground profile data L0 and/or a section of the corrected ground profile data L1';

analyzing the analysis region LA, including determining changes of height; and adapting the leveling control of the road finishing machine for a distance of the analysis region LA by means of data obtained in the analyzing the analysis region LA.

2. The method according to claim 1 further comprising controlling, by the leveling control, a towing point height of a towing point between a screed and a chassis of the road finishing machine.

3. The method according to claim 1, wherein the first ground profile B0 and the second ground profile B1 are one- or two-dimensional and have at least one direction in space parallel to a direction of travel of the road finishing machine.

4. The method according to claim 1, wherein the leveling control comprises at least one of the following controllers: a robust control, an H-infinity control, a model predictive control, and/or a PID controller.

5. The method according to claim 1, wherein the adapting the leveling control comprises selection of one or more leveling sensors which are arranged at different positions in a longitudinal direction of the road finishing machine.

6. The method according to claim 1, wherein the adapting the leveling control is accomplished taking into consideration a wavelength spectrum of changes of height of the foundation and/or detected amplitudes of changes of height determined during the analyzing the analysis region LA.

7. The method according to claim 1, wherein the adapting the leveling control is accomplished on based on a selective weighting of wavelengths of detected changes of height.

8. The method according to claim 1, wherein the determination of the translational and rotational matrix M is effected by means of a scan matching algorithm, in particular an iterative algorithm.

9. The method according to claim 1, wherein the determining the translational and rotational matrix M comprises processing of position data determined by means of a GNSS module, and/or processing of travel drive data and/or processing of stationary georeferencing.

10. The method according to claim 1, wherein the analyzing the analysis region LA comprises a Fast Fourier Transformation and/or a discontinuity detection.

11. The method according to claim 1, wherein layer thickness of an already laid pavement is measured and the adapting the leveling control is accomplished taking into consideration the measured layer thickness.

12. The method according to claim 1, wherein the method is performed for two or several adjacent measuring paths y1, y2 by means of two or several ground profiles scanners arranged at the road finishing machine.

13. A road finishing machine comprising a screed and a chassis, wherein the screed is hinged to the chassis by a screed arm via a towing point, and a towing point height is adjustable by a leveling cylinder, wherein the road finishing machine furthermore comprises at least one leveling sensor, at least one ground profile scanner, and a control system with a leveling controller configured to control the towing point height taking into consideration data of the at least one leveling sensor, and wherein the control system is configured to parameterize the leveling controller based on data detected with the at least one ground profile scanner and based on a translational and rotational matrix M determined from that data, which maps a movement of the road finishing machine in space from a point in time t0 to a point in time t1.

14. The road finishing machine according to claim 13, wherein the at least one leveling sensor comprises two or several leveling sensors which are arranged along a longitudinal direction of the road finishing machine, wherein the control system is configured to select, based on the data detected with the at least one ground profile scanner, one or several leveling sensors to be used with the leveling controller.

15. The road finishing machine according to claim 13, wherein the at least one ground profile scanner comprises a laser scanner.

16. The road finishing machine according to claim 13, wherein the at least one ground profile scanner comprises two or several ground profile scanners.

* * * * *